United States Patent [19]

Moore

[11] Patent Number: 4,936,615

[45] Date of Patent: Jun. 26, 1990

[54] BIN

[75] Inventor: James N. Moore, Ledbury, England

[73] Assignees: Graham John Boyce, Ledbury; Graham Keith Preece, Hereford, both of England

[21] Appl. No.: 418,897

[22] Filed: Oct. 5, 1989

Related U.S. Application Data

[63] Continuation of Ser. No. 122,233, Nov. 10, 1987, abandoned.

[30] Foreign Application Priority Data

Nov. 17, 1986 [GB] United Kingdom ..... 86.27485

[51] Int. Cl.[5] ..... B65D 6/34

[52] U.S. Cl. ..... 294/68.1; 206/512; 206/504; 220/1.5

[58] Field of Search ..... 206/509, 511, 512, 504; 220/1.5; 108/51.1, 53.5; 294/68.1, 68.2, 68.21, 68.26

[56] References Cited

U.S. PATENT DOCUMENTS

| | | | |
|---|---|---|---|
| 2,420,640 | 6/1945 | Acteson | 108/53.5 X |
| 3,521,764 | 6/1968 | Loomis | 206/509 X |
| 3,985,258 | 10/1976 | Quigley et al. | 220/1.5 X |
| 4,375,265 | 3/1983 | van de Wetering et al. | 220/1.5 |
| 4,380,300 | 4/1983 | Mountz et al. | 220/1.5 |

FOREIGN PATENT DOCUMENTS

| | | | |
|---|---|---|---|
| 742776 | 6/1970 | Belgium | 206/509 |
| 854283 | 11/1960 | United Kingdom | 108/53.5 |

*Primary Examiner*—Margaret A. Focarino
*Assistant Examiner*—Dean J. Kramer
*Attorney, Agent, or Firm*—Berman, Aisenberg & Platt

[57] ABSTRACT

A bin having a base and a plurality of side walls. The base is provided with tunnels to allow the tines of a fork lift truck to engage and lift the bin. The side walls are reinforced in regions which are respectively associated with the tunnels and which each extend in an upward direction from the associated tunnel to the upper rim of the bin. As a result, when a stack of such bins is lifted by a fork lift truck, the upward lift from the tines is transmitted upwardly through the reinforced regions of the different bins in the stack.

16 Claims, 7 Drawing Sheets

BIN

This application is a continuation of Ser. No. 122,233, filed Nov. 10, 1987 now abandoned.

The present invention relates to a bin which is designed to be lifted by a fork lift truck.

Hitherto such a bin, especially one which has been made of wood, has had greater strength at its corners, with upright corner posts acting both as the means for securing the side walls, and also as the means by which upward lift from a fork lift truck is transmitted through a stack of such bins. Since the corners are spaced apart from the positions at which the tines of a fork lift truck engage the bin, it is necessary for considerable strength to exist in the base or walls of the bin, between the tine engagement position and the corners of the bin, to prevent the bottom bin in a stack, and its contents, from being distorted or crush on the application of a lifting force by a fork lift truck. This gives the bin a poor strength to weight ratio. Consequently, for the required strength, the cost of the bin is high, and also its weight and bulk are greater, which in turn increases transportation costs.

The present invention seeks to provide a remedy.

Accordingly, the present invention is directed to a bin having side walls which are reinforced in regions which extend from the tine engagement positions to the upper rim of the bin.

Thus there may be provided a bin having a base and a plurality of side walls, in which the base is provided with tunnels to allow the tines of a fork lift truck to engage and lift the bin, the tunnels being spaced from the corners of the bin, and in which the side walls are reinforced in regions which are respectively associated with the tunnels and which each extend in an upward direction from the associated tunnel to the upper rim of the bin, so that when a stack of such bins is lifted by a fork lift truck, the upward lift from the tines is transmitted upwardly through the said regions of the different bins in the stack.

Such a bin may comprise five separate parts: a base panel and four side panels which constitute the side walls in the assembled bin. Releasable connecting means may be provided to enable the bin to be readily assembled and dismantled. The connecting means by which the side walls are connected together are advantageously at the corners of the assembled bin. This is advantageous in that the upright reinforcing regions do not coincide with the connecting means as they do in the prior construction described eariler. The need for bulky connection means is thereby avoided.

Such a construction of bin, whether made as five separate parts or not, is particularly suitable for a plastics bin, because the total volume of material needed to make a bin of given strength is relatively small. The plastics materials may be polypropylene, or high density polyethylene where the bin is to be used for cold room storage. The most appropriate method of moulding is by injection.

Preferably, the upper rim of the bin is also reinforced, so that the construction of the tunnels, the upright reinforced regions, and the rim provides strengthening cradles of the container.

An example of a bin made in accordance with the present invention is illustrated in the accompanying drawings, in which.

Figure 11:
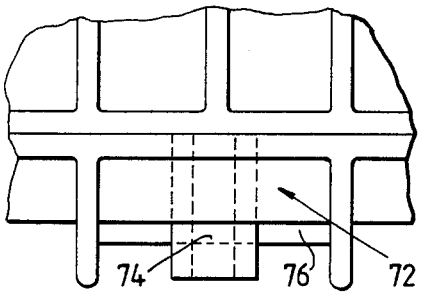
FIGS. 11 and 12 show a side view and a cross-sectional view respectively of a clip detent at positions marked XI in FIG. 1.
Figure 12:
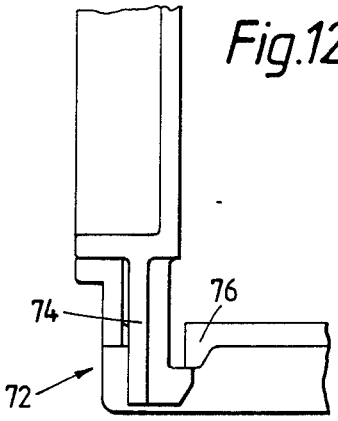

The bin 10 shown in the Figures is a dismantleable plastic fruit bin comprising a rectangular base panel 12, two longer side panels 14, and two shorter side panels 16. The side panels are joined at the bottom edges to respective edges of the base panel 12, in the manner indicated in FIGS. 11 and 12 to be described in greater detail hereinafter. Each shorter panel 16 is joined along its upright edges 18 to the upright edges 20 of the two longer parts 14, at corners 22 of the assembled bin. Each of the five panels is a single piece injection moulded polypropylene component. The two longer panels are identical to one another, as are the two shorter side panels. The base panel 12 is formed with two pairs of transverse tunnels, one pair 24 extending parallel to the longer sides of the base panel and the other pair 26 extending parallel to the shorter sides. Those tunnels accommodate the tines of a fork lift truck (not shown) when the latter is used to lift the bin. They are formed as downwardly open channels, so that the upper surface of the base panel 12 is at two levels: a higher level over the tunnels and a lower level between the tunnels. This increases the total volume available for the goods which the bin is to contain, by affording room between the tunnels.

Each panel comprises a skin 30 molded with many apertures 32 to reduce the weight of the bin and also the amount of material required to make it. The apertures also improve ventilation for the goods contained in the bin when it is in use, and improve drainage from the base of the bin. This is particularly desirable where the bin is to be used for carring fruit or other perishable produce. The panels are also provided with cross-ribbing 34 which is integral with the skin 30 and has some of the ribs extending, in the case of each side wall, in a generally upright direction and some transversely of that, in a generally horizontal direction. In the case of the base panel, some of the ribs extend parallel to the longer sides of the base panel, and some transversely of those, parallel to the shorter sides. The ribbing is formed on the exterior surface of each panel, so that the interior surfaces are smooth. This makes them less likely to damage the contents of the bin, and also facilitates cleaning of the interior surfaces of the bin.

The skin 30 of the base panel 12 rises slightly from its edges to its centre, so that it is at a higher level at its centre than at its sides. The cross-ribbing on the underside of the skin 30 of this panel is correspondingly deeper at the centre of the panel than it is at its sides.

This inhibits sagging of the base under load, and also increases the strength to weight ratio of the panel.

Each side panel has a reinforced upper edge 40. These edges together form a reinforced upper rim 42 of the assembled bin. The reinforcing is effected by having a number of more closely spaced horizontal ribs which are deeper than most of the other ribs. The skin 30 of the panels is recessed slightly at these upper edges to accommodate the deeper ribbing.

Each corner connection between two side panels 14 and 16 is as shown in FIGS. 3 to 10. One of the panels has its horizontal ribbing at its upper rim widened into generally quarter circular webbing 44 with a generally central quarter circular aperture 46. This is shown most clearly in FIG. 7. The other panel of the connection has an upper flange 48 which extends underneath the webbing 44 and upwardly from which extends a spigot 50 of generally quarter circular section. The spigot 50 fits closely in the aperture 46 when the bin is assembled.

At each corner connection, one of the panels has its skin formed into an L-sectioned edge portion 52 which extends from the bottom of the bin to the top. The L-section defines the outer corner of the bin. The other panel of the corner connection has its skin formed into an inwardly curving arcuate sectioned edge portion 54, set at 45 degrees to the rest of that panel. The edge portion 54 also extends from the bottom of the bin to the top, and between the two ends of the "L" of the edge portion 52 when the bin is assembled. Thus the portion 54 is hidden by the portion 52 unless the bin is viewed from its interior. At certain levels marked V in FIG. 3, triangular horizontal webs 58 extend inwardly from the L-sectioned portion 52, with which the webs 58 are integral. Similarly, webs 60 extend outwardly from the arcuate-sectioned portion 54. The webs 58 and 60 both fit closely in the space defined between the portions 52 and 54, and at any given level V, the web 58 is in contact with the web 60. The webs 56 and 58 reinforce their associated edge portions and locate the panels relative to one another.

Relative angular movement between the side panels is inhibited by the engagement of the spigot 50 in the aperture 46, which therefore resists rhomboidal distortion of the bin. The tunnels 24 and 26, by virtue of their width, also resist rhomboidal distortion.

Figure 6:
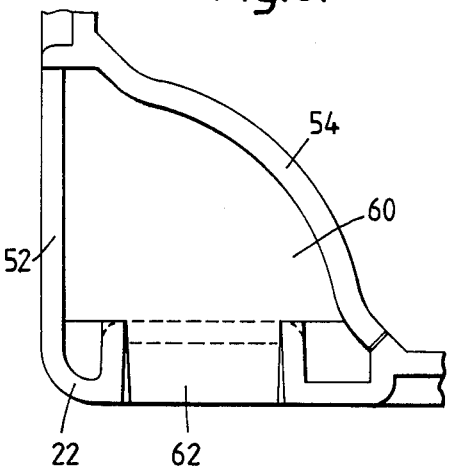
Figure 7:
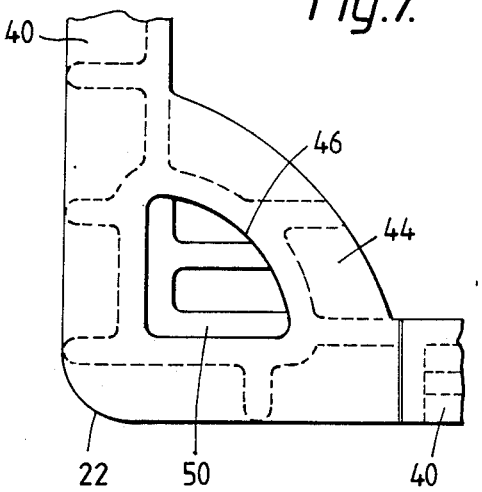
Figure 8:
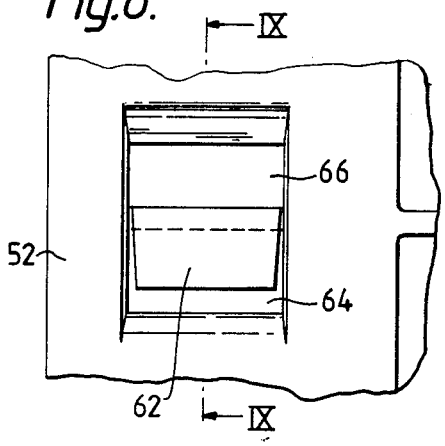
FIG. 8 shows a side elevational view of the corner at level VI shown in FIG. 3.
Figure 9:
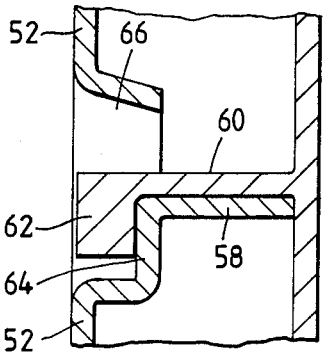
FIG. 9 shows a cross sectional view of the corner taken along the lines IX—IX in FIG. 8.
Figure 10:
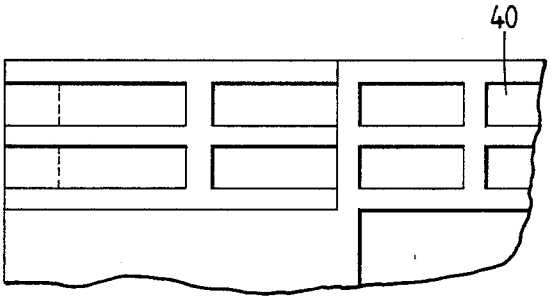
FIG. 10 shows a side elevational view of the corner at level VII shown in FIG. 3.

Bursting forces which might tend to tear the bin apart at the corners when the bin is in use are resisted by the formations shown in FIGS. 6, 8 and 9. These show a modified form of the web construction shown in FIG. 5 which exists at levels VI shown in FIG. 3. The web 60 is in this case formed with a downwardly extending latching portion 62, and on the assembled bin this hooks into a stepped recess 64 formed between one side of the L-sectioned edge portion 52 and the web 58. An aperture 66 is provided in the edge portion 52 above the recess 64, and the edges of the portion 52 around this aperture are turned inwardly. The aperture 66 provides a space for the latching portion 62 to pass over the web 58 before it snaps into the recess 64 when the bin is being assembled.

Figure 4:
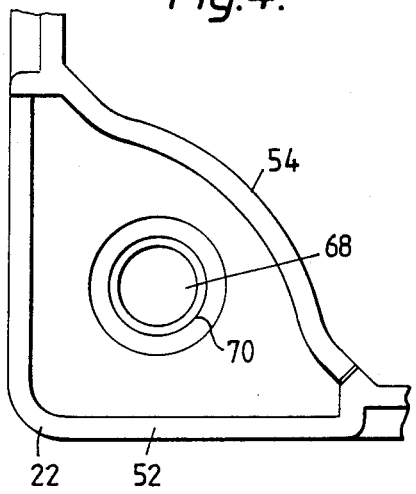
FIGS. 4 to 7 show cross sectional through the corner shown in FIG. 3, at levels IV, V, VI and VII marked thereon.
Figure 5:
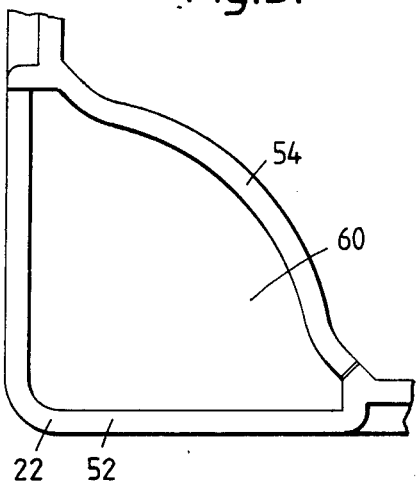

Once the four side walls have been put together in this way, the assembly is turned upside down and the base panel 12 is positioned on the top of the inverted assembly. The base panel 12 is moulded with four frusto-conical posts 68 extending from its four corners in an upward direction when the base panel 12 is in its normal orientation, but while the bin is being put together they are directed downwardly towards the four corners of the side wall assembly. FIG. 4 shows how some of the webs 58 and 60 are formed with central holes 70 which accommodate the posts 68 as the base panel 12 is brought down upon the bottom edges of the inverted side wall assembly. A final snap fit is achieved by means of clip detents 72 shown in FIGS. 11 and 12. These are positioned, in the illustrated bin, at locations marked XI in FIG. 1, and comprise a normally downwardly extending hook 74 which snaps over a thickened lip 76 of the upper edge of a tunnel end.

Figure 2:
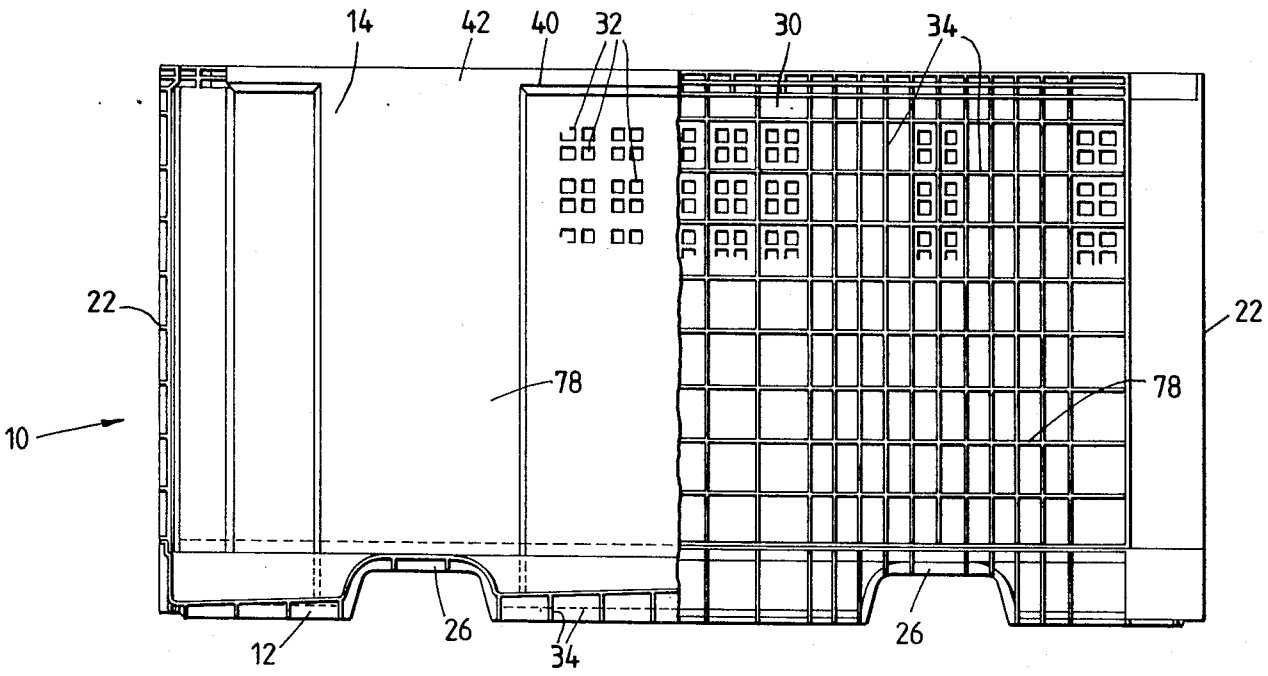
FIG. 2 is an elevational, partly sectional view of the bin.
Figure 3:
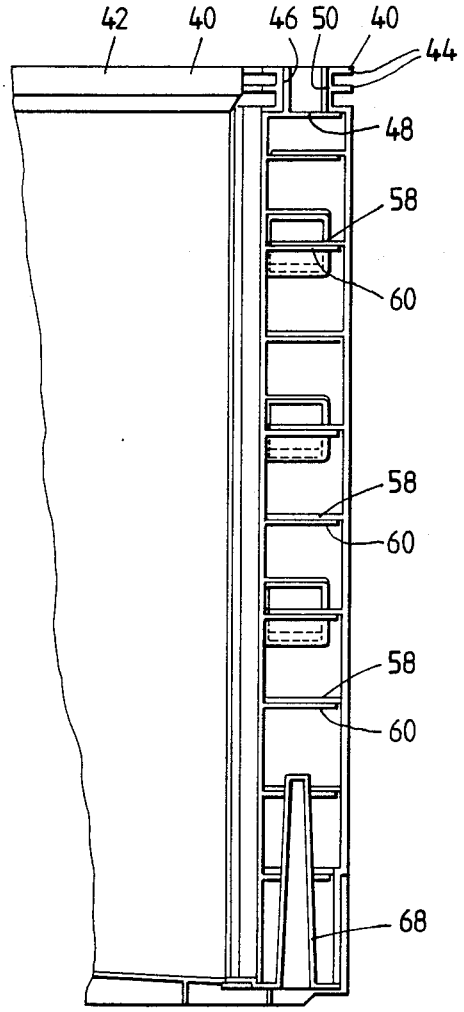
FIG. 3 is an elevational sectional view through a corner of the bin.

As shown in FIG. 2, the cross-ribbing on the underside of the base panel 12 is shallower around the edges of the panel, to enable it to be located within the rim 42 of a lower bin and so avoid slipping between adjacent bins in a stack.

Figure 1:
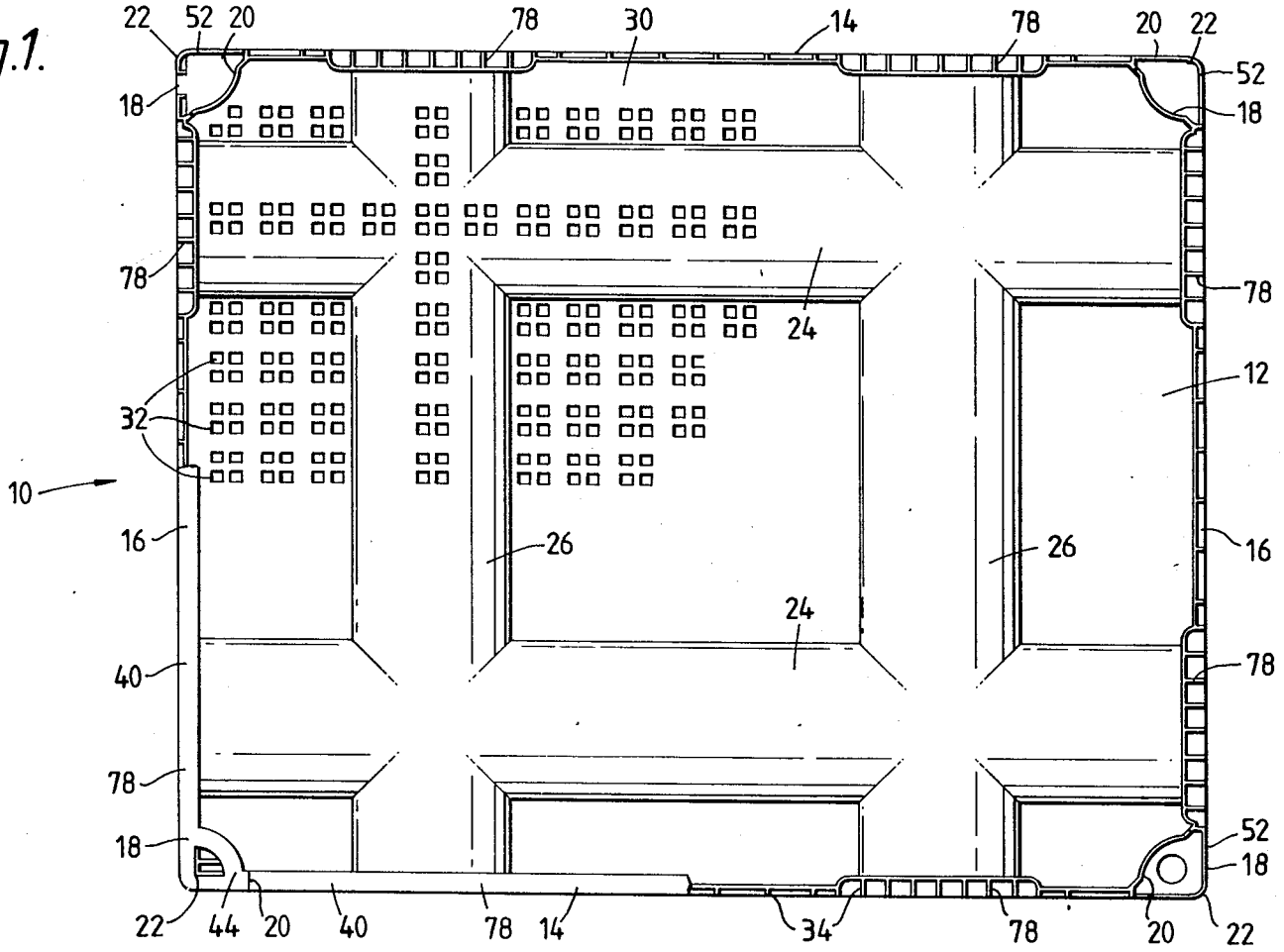
FIG. 1 is a plan, partly sectional view of the bin.

As is clearly shown in FIG. 1, the side panels 14 and 16 are each reinforced in regions 78 which are respectively associated with the tunnels and which each extend in a horizontal direction to positions beside and above the associated tunnel, and in a vertical direction from the bottom of the bin to the upper rim of the bin. In the illustrated construction, the reinforcement is achieved by having the skin 30 of the panel recessed inwardly, and by making the cross-ribbing in these regions correspondingly deeper. As a result, when a stack of bins, each like the one illustrated, is lifted by a fork lift truck, the upward lift toward the tines is transmitted upwardly through the reinforced regions 78 of the different bins in the stack.

Figure 13:
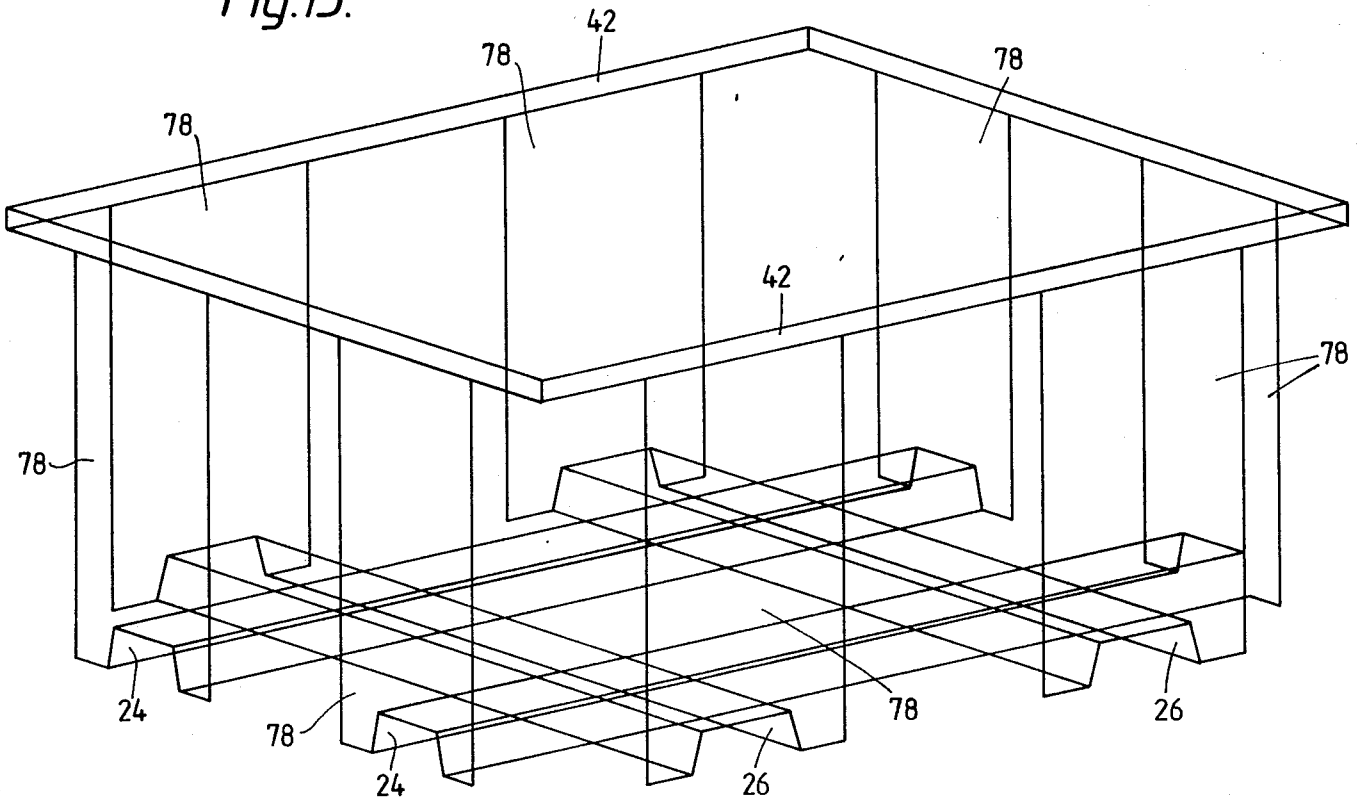
FIG. 13 shows a perspective diagrammatic view of reinforcing parts of the bin which together constitute four linked cradles of the bin.

FIG. 13 shows diagrammatically the configuration of the strengthening parts of the assembled bin. The tunnels 24 and 26 themselves are strengthening, because of their channel shape. The regions 78 extend upwardly from the tunnels 24 and 26 to the rim 42. Thus, in the illustrated construction, the strengthening parts provide four interlocked cradles.

It will be noted that the regions 78 extend to the sides of the tunnels at their lower ends, so that they will contact the rim of a bin which may be underneath, at positions immediately above the regions 78 of such a lower bin. This ensures continuous upright lengths of reinforced regions throughout the height of a stack of bins. However, in the event that the regions 78 do not also extend to the sides of the tunnels, so that they are confined exclusively to regions above the tunnels, transmission of the lift forces from the tines is still made effective and acceptable through a whole stack of bins. This follows because the lift forces are transmitted through the upright reinforcing regions 78 of the bottom bin to the upper rim 42 of that bottom bin. Since the tunnels of the next-to-bottom bin lie across and on top of this rim 42 of the bottom rim, they in turn transmit the lifting forces to their associated upright reinforcing regions 78, and so on through the stack.

It will be appreciated that the illustrated bin has eight upright stengthening regions rather than the four at the corner posts of the conventional constructions.

Numerous other modifications and variations to the illustrated bin will occur to the reader without taking it outside the scope of the present invention. As one simple example, the hook 74 of the clip detents 72 in FIGS. 11 and 12 might equally well be formed on the base panel 12 as on the side panels 14 and 16.

Whilst the illustrated bin has tunnels for accommodating the tines of a fork lift truck, a less desirable but possible construction would be to have, for example, corner supports extending downwardly from the four corners of the bin below the base. The upright reinforcing regions would then extend upwardly from positions where the tines of a fork lift truck are intended to engage the base. This would require strengthened edges of the base to transmit a lifting force through a stack of bins from the corner supports of each bin to its upright reinforcing regions.

The illustrated bin is about 1,200 mm long× 1,000 mm wide×650 mm high, with all other dimensions in proportion according to the scales of FIGS. 1 to 12, although it will be appreciated that the invention is not limited to these dimensions or proportions and may for example have a square base, and may be shallower than as illustrated.

The use of a skin and reinforcing cross-ribbing for the panels gives a high strength-to-weight ratio, and also avoids the presence of any bulky solid portions which would involve shrinkage problems when the moulded panels cool.

UV stabilizers may be included in the plastics material to make it more resistant to sunlight.

It will be appreciated that the tunnels in the base portion of the illustrated bin prevent sideways slipping of the bin on the tines of a fork lift truck.

I claim:

1. A synthetic plastics bin having a synthetic plastics base and a plurality of synthetic plastics side walls, so that the corner regions of the bin are defined by regions where adjacent side walls meet, and a rim of the bin is defined by the edges of the side walls furthest from the base, in which at least one of the sides of the bin has two apertures spaced apart along an intended bottom edge of the bin, for receiving the tines of a fork lift truck, in which at least one of the said side walls of the bin is integrally moulded with a distribution of plastics material which is such as to reinforce the wall against vertical compression in regions which extend from the vicinity of the apertures upwardly to the rim of the bin, in which those reinforced regions, parts of the side wall adjacent thereto, and corner regions of the said at least one side wall are all parts of one and the same integrally moulded component, in which those reinforced regions are more resistant to vertical compression than any and every region of corresponding width of the rest of the wall structure of the bin, the integral moulding thereby avoiding the need for reinforcement against vertical compression at the corner regions of the bin, and in which such reinforcement extends to positions beside the apertures, whereby an upward lift from the tines of a fork lift truck which engage the lowermost bin of a stack of such bins is transmitted through the reinforced regions of the bins in the stack.

2. A synthetic plastics bin according to claim 1, comprising five separable parts constituted by a base panel and four side panels which constitute said synthetic plastics side walls of the bin.

3. A synthetic plastics bin according to claim 2, in which the bin is provided with releasable connecting means to enable the bin to be readily assembled and dismantled.

4. A synthetic plastics bin according to claim 3, in which said releasable connecting means by which said side walls are connected together are at the corners of the assembled bin.

5. A synthetic plastics bin according to claim 1, in which said synthetic plastics comprises polypropylene.

6. A synthetic plastics bin according to claim 1, in which said synthetic plastics comprises high density polyethylene.

7. A synthetic plastics bin according to claim 1, made of at least one injection moulded part.

8. A synthetic plastics bin according to claim 1, in which said rim of the bin is also reinforced.

9. A synthetic plastics bin having a synthetic plastics base and a plurality of synthetic plastics side walls, so that the corner regions of the bin are defined by regions where adjacent side walls meets, and a rim of the bin is defined by the edges of the side walls furthest from the base, in which at least one of the sides of the bin has two apertures spaced apart along an intended bottom edge of the bin, for receiving the tines of a fork lift truck, in which at least one of the said side walls of the bin is integrally moulded with a distribution of plastics material which is such as to reinforce the wall against vertical compression in regions which extend from the vicinity of the apertures upwardly to the rim of the bin, in which those reinforced regions, parts of the side wall adjacent thereto, and corner regions of the said at least one side wall are all parts of one and the same integrally moulded component, in which those reinforced regions are more resistant to vertical compression than any and every region of corresponding width of the rest of the wall structure of the bin, the integral moulding thereby avoiding the need for reinforcement against vertical compression at the corner regions of the bin, in which the strength of the base of the bin is no greater at positions between each aperture and the corner of the bin nearest thereto, than it is in central regions of the base, and in which such reinforcement extends to positions beside the apertures, whereby an upward lift from the tines of a fork lift truck which engage the lowermost bin of a stack of such bins is transmitted through the reinforced regions of the bins in the stack.

10. A synthetic plastics bin according to claim 9, comprising five separable parts constituted by a base panel and four side panels which constitute said synthetic plastics side walls of the bin.

11. A synthetic plastics bin according to claim 10, in which the bin is provided with releasable connecting means to enable the bin to be readily assembled and dismantled.

12. A synthetic plastics bin according to claim 11, in which said releasable connecting means by which said side walls are connected together are at the corners of the assembled bin.

13. A synthetic plastics bin according to claim 9, in which said synthetic plastics comprises polypropylene.

14. A synthetic plastics bin according to claim 9, in which said synthetic plastics comprises high density polyethylene.

15. A synthetic plastics bin according to claim 9, made of at least one injection moulded part.

16. A synthetic plastics bin according to claim 9, in which said rim of the bin is also reinforced.

* * * * *